US005170574A

United States Patent [19]

Weisbrich

[11] Patent Number: 5,170,574

[45] Date of Patent: Dec. 15, 1992

[54] FOOTWEAR SOLE-TO-SURFACE CONNECTOR FOR ON-DEMAND OMNIDIRECTIONAL DISENGAGEMENT MEANS

[76] Inventor: Alfred L. Weisbrich, 3 Lenora Dr., West Simsbury, Conn. 06092

[21] Appl. No.: 628,093

[22] Filed: Dec. 17, 1990

Related U.S. Application Data

[63] Continuation-in-part of Ser. No. 362,519, Jun. 7, 1989, abandoned.

[51] Int. Cl.[5] ..... A43B 5/00

[52] U.S. Cl. ..... 36/131; 36/132; 36/136; 36/25 R; 2/DIG. 6

[58] Field of Search ..... 36/116, 132, 136; 2/DIG. 6; 54/47, 49

[56] References Cited

U.S. PATENT DOCUMENTS

| | | | |
|---|---|---|---|
| 4,050,168 | 9/1977 | Pace | 36/136 |
| 4,055,005 | 10/1977 | Meinhart | 2/DIG. 6 X |
| 4,108,452 | 8/1978 | Baron | 2/DIG. 6 X |
| 4,271,566 | 6/1981 | Perina | 2/DIG. 6 X |
| 4,457,510 | 7/1984 | Pertschuk | 2/DIG. 6 X |
| 4,538,480 | 9/1985 | Trindle | 36/131 X |
| 4,591,148 | 5/1986 | Slater | 2/DIG. 6 X |
| 4,599,914 | 7/1986 | Dunn et al. | 36/131 X |
| 4,645,466 | 2/1987 | Ellis | 36/132 X |
| 4,807,372 | 2/1989 | McCall | 36/135 |
| 4,836,047 | 6/1989 | Alcamo | 36/131 X |
| 4,856,211 | 8/1989 | Phillips | 36/131 |

FOREIGN PATENT DOCUMENTS

| | | | |
|---|---|---|---|
| 93139 | 8/1897 | Fed. Rep. of Germany | 36/131 |

OTHER PUBLICATIONS

Velcro Corp. Advertisement, *Women's Wear Daily*, #1020, Feb. 14, 1968.

*Primary Examiner*—Paul T. Sewell
*Assistant Examiner*—BethAnne C. Cicconi

[57] ABSTRACT

A new and improved connector is provided for footwear and associated specific footwear step-on devices and surfaces. The invention utilizes complementing members of a type of separable, coacting, flexible gripping means, such as hook and loop "Velcro" type or knob-knob type or other similar flexible type fastening members. These members are arranged to form an integral firmly attached part of the invention specific sole of footwear worn by individuals and associated interfacing invention tailored step-on device surfaces and permit proper positioning mating and omnidirectional on-demand break-away disengagement between footwear sole and interfacing step-on device surfaces. The connector is enhanced and applicable to devices other than designated pedals of the prior application including to stirrups, skis and devices such as skateboards, snowboards, and surfboards among other step-on devices and surfaces for the purpose of yielding proper positive foot positioning, slip and pull-resistance, anatomical motion compliance and on-demand omnidirectional release. In summary, the invention provides improved device engagement, combined contact and disengagement enhancement for expanded functional effectivity and performance, including more safety and comfort, and effective off-surface mobility.

20 Claims, 2 Drawing Sheets

FOOTWEAR SOLE-TO-SURFACE CONNECTOR FOR ON-DEMAND OMNIDIRECTIONAL DISENGAGEMENT MEANS

This is application is a continuation-in-part of U.S. Ser. No. 07/362,519, filed Jun. 7, 1989 "Flexible Gripping Footwear Soles and Step-on Surfaces for On-demand Sole-to-Surface Mating and Disengagement Means", now abandoned.

In activities requiring properly positioned contact between footwear and surfaces of devices such as bicycle pedals, riding stirrups, skis and board devices such as skateboards, snowboards and other footwear-interfacing surfaces it may be useful or desirable to have easy proper positioning properties, good operational and anatomically comfortable attachment of footwear to said surfaces as well as on-demand omnidirectional contact release properties.

Mechanisms, for example, such as current pedal toeclips, clipless pedals for bicycles, and ski bindings for skis, have been developed to accommodate the desire for temporary attachment of footwear to equipment such as skis or pedals with some provision for footwear release especially under abnormal situations such as falls and sudden unanticipated impact. Under some circumstances, for example, bicycle pedals with toeclips, current clipless pedals, boots on waterskis, or skis with mechanical ski bindings, release of footwear from said mechanisms may not be possible if the retention mechanisms for foot or footwear attachment are engaged inadvertently too tightly. For most foot retention mechanisms release may still not be possible since separation is possible only in limited directions. For current step-on devices such as riding stirrups the present absence of provisions for proper foot positioning and foot retention has riders at risk of having a stirrup move to improper locations on the foot or totally disengage with potentially disasterous consequence if the rider falls and gets entrapped in the stirrup.

The present invention provides a desirable and acceptable connector for footwear attachment applicable to a variety of step-on devices and surfaces such as pedals, stirrups, board devices and skis among others having invention tailored configuration footwear soles and step-on surfaces while also providing proper footwear positioning means, anatomical motion compliance and on-demand break-away disengagement release under virtually all conditions.

SUMMARY OF THE INVENTION

A new and improved connector is provided for footwear and associated specific footwear step-on devices and surfaces. The invention utilizes complementing members of a type of separable, coacting, flexible gripping means, such as hook and loop "Velcro" type or knob-knob type or other similar flexible type fastening members. These members are arranged to form an integral firmly attached part of the invention specific sole of footwear and interfacing invention tailored step-on device surfaces to permit mating attachment, anatomical motion compliance and on-demand break-away disengagement release under virtually all conditions in conjunction with complementary protrusions and holes for providing proper footwear positioning means. Said connector is applicable to pedals, stirrups, board devices and skis among other step-on device surfaces for the purpose of yielding a positive proper positioning, slip and pull-resistant, anatomically compliant and on-demand omnidirectionally separable mating interface. This capability is accomplished by means of firmly attached hook-and-loop or knob-knob type coacting intefacing members to both the soles of footwear and to said step-on device surfaces. The contours of said connecting surfaces are approximately common although both surfaces may contain local facets that are substantially out of plane but common to each other at the proper point of engagement. Under operation, the connector provides slip or shearload-resistance, pull or tensile force-resistance as well as on-demand omnidirectional release means, largely through peel-action, between said footwear and step-on surfaces. Thus, the invention provides for desirable operational attachment forces while yielding additional expanded functional effectivity, including orthopedic comfort via mated compliance, ease of engagement and proper foot positioning via the presence of complementary sole and surface protrusions and holes, and safe omnidirectional footwear release means. Additionally, a footwear sole protector is provided to protect said footwear sole when not engaged with the associated step-on device surface. Said protector is engaged in a similar manner as said step-on device surface, and has a wear resistant walking surface on one side. The protector may be hinge fastened to the footwear for ease of access, sole attachment and removal and stowage on the footwear or be totally removable from said footwear for storing when not in use on the sole. The invention may be implemented at the attendant footwear and mating device level or be made to be retrofitted to said footwear and mating device surfaces.

DETAILED DESCRIPTION

Figure 1:
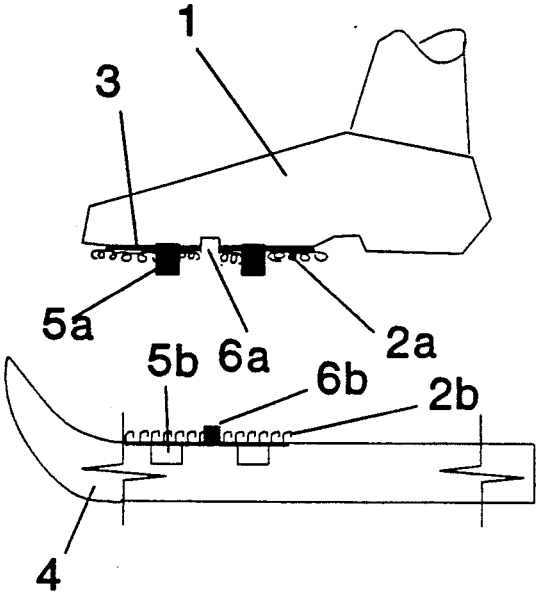
FIG. 1 is a cutaway side elevation view of one application and embodiment of the invention illustrated on footwear and a ski.

FIG. 1 is said side elevation view of one application and embodiment of the invention on footwear 1 in part comprised of one member and type of separable, coacting, flexible gripping elements 2*a* such as "Velcro" type fastening loop members attached firmly to a footwear sole surface through cohesive bonding means 3. One desired footwear position locating and attachment means for proper interface positioning on a step-on device surface such as the noted ski 4 is accomplished with a number of sole surface protrusions 5*a* and holes 6*a* and a complementary set of step-on surface holes 5*b* and protrusions 6*b* together with the complementary member of said gripping elements 2*b*.

Figure 2:
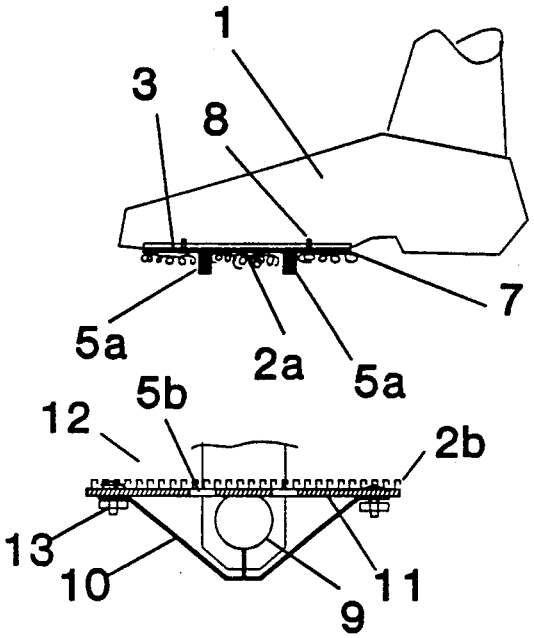
FIG. 2 is a cutaway side elevation view of another application and embodiment of the invention illustrated on footwear and a self-leveling bicycle pedal.

FIG. 2 shows a side elevation view of another application and embodiment of the invention comprised of footwear 1 comprised of one member and type of separable, coacting, flexible gripping elements 2*a* such as a looped "Velcro" type attached directly and firmly to a sole plate 7 through cohesive attachment or bonding means 3 and said soleplate attached firmly to the footwear sole by means of fasteners 8; desired footwear position locating and attachment means for proper interface positioning on a step-on device surface such as the noted pedal 12 is accomplished with a multitude of sole surface protrusions 5*a* and a complementary set of step-on surface holes 5*b* together with the complementary member of said gripping elements 2*b*. Said pedal is furthermore self-leveling comprised of pedal support spar and spindle 9, vertically counterbalancing step-on platform surface support structure 10 emanating from said spar opposite step-on surface platform 11 and said complementary member separable, coacting, flexible gripping means 2*b* firmly attached to said platform and further secured in connection with platform 11 and supports 10 by means of fasteners 13. The removable footwear bottom surface plates and device surface platform plates, which may have arbitrary matching contours, are denoted to also convey the retrofitting potential of the invention to standard footwear and device surfaces.

Figure 3:
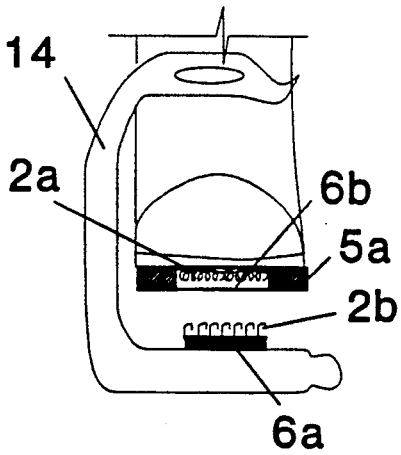
FIG. 3 is a cutaway front elevation view of another application and embodiment of the invention illustrated on footwear, being a riding boot, and a stirrup.

FIG. 3 illustrates an elevation view of another application and embodiment of the invention comprised of footwear 1 comprised of one member and type of separable, coacting, flexible gripping elements 2*a* such as a looped "Velcro" type attached firmly to the bottom of said footwear; footwear position locating and attachment means, for proper interface positioning on a step-on device surface such as the noted stirrup 14, is accomplished with a sole surface protrusion 5*a* forming a hole 6*b* with said gripping elements firmly attached at its bottom and being complementary to step-on surface protrusion 6*a* together with the complementary member of said gripping elements 2*b* firmly attached on tip end of protrusion 6*a*.

Figure 4:
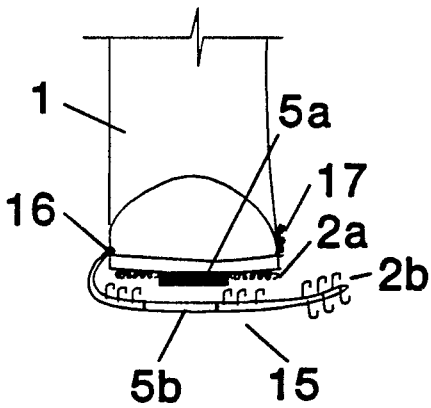
FIG. 4 is a cutaway front elevation view of the invention illustrated on footwear, being a riding boot, and an associated footwear sole protector.

FIG. 4 shows a front elevation view of another application and embodiment of the invention on footwear 1 in part comprised of one member and type of separable, coacting, flexible gripping elements 2*a* such as a looped "Velcro" type fastening members attached directly and firmly to a footwear sole or bottom surface with desired footwear position locating and attachment means for proper interface positioning on a step-on device surface such as the noted sole protector 15 accomplished via one or more of sole surface protrusions 5*a* and a complementary set of protector surface holes 5*b* together with the complementary member of said gripping elements 2*b* on said protector. The protector is also connected to footwear by hinge element 16 and can be further secured off the sole to the footwear by means of a patch of the complementary gripping member means attached to the footwear.

Figure 5:
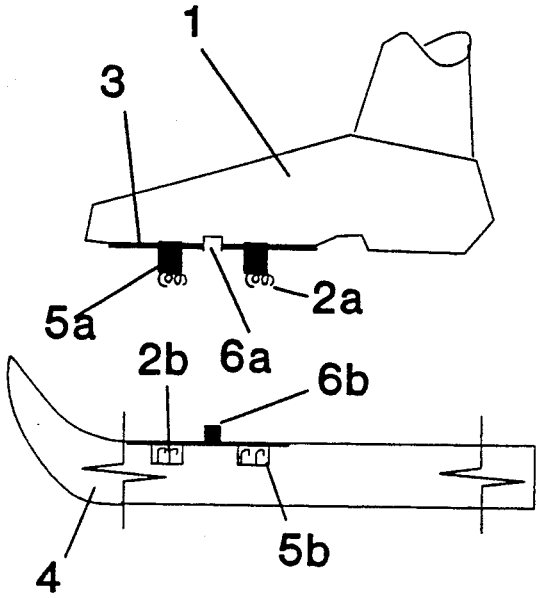
FIG. 5 is a cutaway side elevation view of one application and varied embodiment of the invention illustrated on footwear and a ski.

FIG. 5 is said side elevation view of one application and varied embodiment of the invention on footwear 1 in part comprised of one member and type of separable, coacting, flexible gripping elements 2*a* such as "Velcro" type fastening loop members attached firmly to tip ends of protrusions 5*a* which are embodied in a footwear sole surface; one desired footwear position locating and attachment means for proper interface positioning on a step-on device surface such as the noted ski 4 is accomplished with a number of said sole surface protrusions 5*a* and holes 6*a* and a complementary set of step-on surface holes 5*b* and protrusions 6*b* together with the complementary member of said gripping elements 2*b* firmly attached to bottoms of said holes 5*b*.

Figure 6:
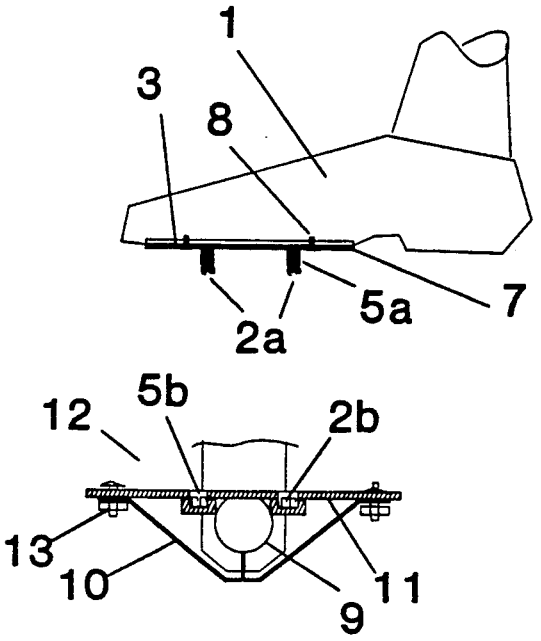
FIG. 6 is a cutaway side elevation view of another application and varied embodiment of the invention illustrated on footwear and a self-leveling bicycle pedal.

FIG. 6 shows a side elevation view of another application and varied embodiment of the invention comprised of footwear 1 comprised of one member and type of separable, coacting, flexible gripping elements 2*a* such as a looped "Velcro" type attached firmly to tip ends of protrusions 5*a* which are embodied in a sole plate 7 and said soleplate attached firmly to the footwear sole by means of fasteners 8; desired footwear position locating and attachment means for proper interface positioning on a step-on device surface such as the noted pedal 12 is accomplished with a multitude of sole surface protrusions 5*a* and a complementary set of step-on surface holes 5*b* together with the complementary member of said gripping elements 2*b* firmly attached to bottoms of said holes 5*b*. Said pedal is furthermore self-leveling comprised of pedal support spar and spindle 9, vertically counterbalancing step-on platform surface support structure 10 emanating from said spar opposite step-on surface platform 11 and secured in connection with platform 11 by means of fasteners 13. The removable footwear bottom surface plates and device surface platform plates, which may have arbitrary matching contours, are denoted to also convey the retrofitting potential of the invention to standard footwear and device surfaces.

Figure 7:
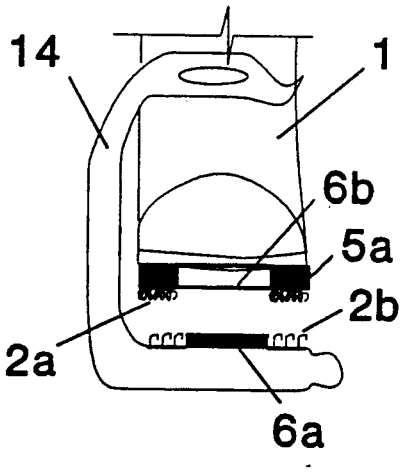
FIG. 7 is a cutaway front elevation view of another application and varied embodiment of the invention illustrated on footwear, being a riding boot, and a stirrup.

FIG. 7 illustrates an elevation view of another application and varied embodiment of the invention comprised of footwear 1 comprised of one member and type of separable, coacting, flexible gripping elements 2*a* such as a looped "Velcro" type attached firmly to bottom surface 5*a* of said footwear; footwear position locating and attachment means, for proper interface positioning on a step-on device surface such as the noted stirrup 14, is accomplished with said sole surface 5*a* about a hole 6*b* and being complementary to step-on surface protrusion 6*a* together with the complementary member of said gripping elements 2*b* firmly attached to stirrup 14.

Figure 8:
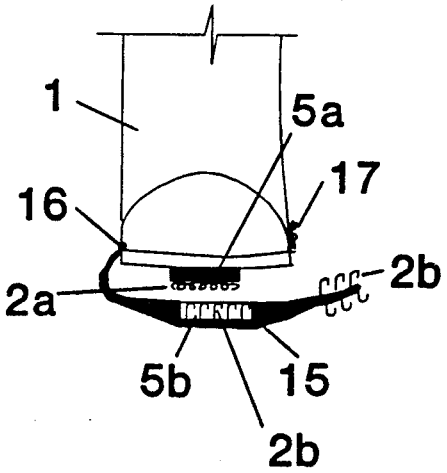
FIG. 8 is a cutaway front elevation view of another variation of the invention illustrated on footwear, being a riding boot, and an associated footwear sole protector.

FIG. 8 shows a front elevation view of another application and varied embodiment of the invention on footwear 1 in part comprised of one member and type of separable, coacting, flexible gripping elements 2*a* such as a looped "Velcro" type fastening members attached firmly to tip ends of protrusions 5*a* which are embodied in footwear sole or bottom surface with desired footwear position locating and attachment means for proper interface positioning on a step-on device surface such as the noted sole protector 15 accomplished via mating of one or more of said sole surface protrusions 5*a* and a complementary set of protector surface holes 5*b* together with the complementary member of said gripping elements 2*b* firmly attached to the bottoms of said holes 5*b* on said protector. The protector is also connected to footwear by hinge element 16 and can be further secured off the sole to the footwear by means of a patch of the complementary gripping member means attached to the footwear.

While the foregoing descriptions have been characterized as being preferred, it will be obvious that various changes and modifications may be made therein as well as a multitude of comparable applications identified without departing from the spirit and scope of the invention as defined in the following claims.

I claim:

1. Footwear sole-to-surface connector apparatus attaching a bottom surface of footwear to a second surface comprising:

(a) flexible coacting gripping means having a first portion and a second portion, said first portion being firmly attached to said bottom surface, said second portion being firmly attached to said second surface and said first and second portions engaging in approximately a common contoured plane; and (b) at least one relatively complementary protrusion and hole each integral with one of said bottom surface and said second surface in the area of said gripping means for joining to properly position said footwear on said surface, said apparatus on demand being disengageable substantially omnidirectionally out of said common plane.

2. Footwear sole-to-surface connector apparatus attaching a bottom surface of footwear to a second surface comprising:

flexible coacting gripping means having a first portion and a second portion;

said first and second portion engaging in approximately a common contoured plane and being disengageable substantially omnidirectionally out of said plane;

and said bottom surface and said second surface having together at least one relatively complementary protrusion and hole with respect to each other for joining to properly position said footwear on said surface;

said first portion attaching firmly to at least one bottom of said at least one hole, and said second portion attaching firmly to at least one tip end of said at least one protrusion, said hole bottoms and tip ends of protrusions being of similar contour.

3. Apparatus according to claim 1 wherein said protrusion emanates from said bottom surface only and said approximately complementary hole is on said second surface only.

4. Apparatus according to claim 1 wherein said protrusion emanates from said surface only and said approximately complementary hole is on said bottom surface only.

5. Apparatus according to claim 3 wherein said flexible coacting gripping means is comprised of hook and loop type fastening members.

6. Apparatus according to claim 5 wherein said second surface is a pedal.

7. Apparatus according to claim 1 wherein said second surface is a stirrup.

8. Apparatus according to claim 5 wherein said second surface is a ski.

9. Apparatus according to claim 6 wherein said pedal is self-leveling with said pedal comprised of a step-on platform, having a surface contour, adjacent to a pedal support spar spin axis and with platform support means, substantially opposite the platform relative to the pedal spin axis, which additionally serves to lower the center of gravity point below the pedal support spar spin axis for allowing substantially self-levelizing of the platform surface.

10. Apparatus according to claim 5 wherein said second surface is a bottom surface protector and wherein said protector is further comprised of a wear resistant ground engaging surface intended to protect said bottom surface and which is connected to footwear by a hinge element and a patch of the flexible coacting gripping means to.

11. Apparatus according to claim 5 wherein the bottom surface of said footwear is a removable sole plate secured by fasteners to said footwear and wherein said second surface has a removable mating plate secured by fasteners thereto.

12. Apparatus according to claim 2 wherein said hole is only on said bottom surface and said protrusion only emanates from said second surface.

13. Apparatus according to claim 2 wherein said hole is only on said second surface and said protrusion only emanates from said bottom surface.

14. Apparatus according to claim 12 wherein said flexible coacting gripping means is comprised of hook and loop type fastening members.

15. Apparatus according to claim 12 wherein said second surface is a pedal.

16. Apparatus according to claim 12 wherein said second surface is a stirrup.

17. Apparatus according to claim 12 wherein said second surface is a ski.

18. Apparatus according to claim 12 wherein said second surface is a bottom surface protector and wherein said protector is further comprised of a wear resistant ground engaging surface intended to protect said bottom surface, and which is connected to footwear by a hinge element and a patch of the flexible coacting gripping to.

19. Apparatus according to claim 12 wherein the bottom surface of said footwear is a removable sole plate secured by fasteners to said footwear and wherein said second surface has a removable mating plate secured by fasteners thereto.

20. Apparatus according to claim 13 wherein said flexible coacting gripping means is comprised of hook and loop type fastening members.

* * * * *